United States Patent [19]

Law et al.

[11] Patent Number: 4,986,427

[45] **Date of Patent: * Jan. 22, 1991**

[54] STORAGE RACK

[75] Inventors: Donel G. Law, R.R. 1, Box 232B, Tipton, Ind. 46072; Harold Powell, Columbus, Ind.

[73] Assignee: Donel G. Law, Tipton, Ind.

[ * ] Notice: The portion of the term of this patent subsequent to Jan. 10, 2006 has been disclaimed.

[21] Appl. No.: 259,761

[22] Filed: Oct. 19, 1988

Related U.S. Application Data

[63] Continuation-in-part of Ser. No. 65,842, Jun. 24, 1987, Pat. No. 4,796,762.

[51] Int. Cl.[5] ..... A47F 7/00

[52] U.S. Cl. ..... 211/64; 211/70.8; 211/88; 211/117

[58] Field of Search ..... 211/4, 64, 70.8, 113, 211/117, 88; 70/58, 62

[56] References Cited

U.S. PATENT DOCUMENTS

| | | | |
|---|---|---|---|
| D. 272,787 | 1/1984 | Rumbaugh . | |
| 1,837,939 | 12/1931 | Zimmerman . | |
| 2,535,564 | 12/1950 | Campbell . | |
| 2,577,713 | 12/1951 | Nogle . | |
| 2,797,033 | 6/1957 | Rasbach . | |
| 2,855,108 | 10/1958 | Haapala | 211/64 |
| 2,972,419 | 2/1961 | Zelen et al. . | |
| 3,167,182 | 1/1965 | Calvin . | |
| 3,291,317 | 12/1966 | Bowen . | |
| 3,355,030 | 11/1967 | Cathcart . | |
| 3,421,632 | 1/1969 | Wood . | |
| 3,635,433 | 1/1972 | Anderson . | |
| 3,558,090 | 1/1971 | Bird . | |
| 3,635,746 | 10/1975 | Burton | 211/64 |
| 3,907,118 | 9/1975 | Pelavin . | |
| 4,003,612 | 1/1977 | Munsell . | |
| 4,027,798 | 6/1977 | Swaim | 211/70.8 X |
| 4,132,281 | 1/1979 | McClellan . | |
| 4,132,315 | 1/1979 | Young | 211/4 |
| 4,387,873 | 6/1983 | Pavlo et al. . | |
| 4,796,762 | 1/1989 | Law | 211/64 |

*Primary Examiner*—Robert W. Gibson, Jr.
*Attorney, Agent, or Firm*—Woodard, Emhardt, Naughton, Moriarty & McNett

[57] ABSTRACT

The present invention provides a storage rack suitable for storing rifles, shotguns, fishing rods and the like. The present invention provides, in one embodiment, a fishing tackle box suspended below the storage rack. The rack may have a separate storage compartment therein. The invention also provides, in one embodiment, for the storage rack to be hung from hooks over the top of a door, and flexible suspension straps may be used to provide support. Gear, such as guns, may be held in place by velcro straps wrapped around the gun barrel. The storage rack of the present invention may include laterally projecting fishing rod holders for elongated fishing rods, as well as a holder for a protective fishing rod case. The butts of guns may be received in an elongated first recess or alternatively fishing rods may be received in a second recess nested in the elongated first recess. An upper support member for holding the upper end of the gear to be stored may include a main body and a slide member which is laterally slidable with respect to said main body and including at least one arm extending laterally across a slot for opening and closing the slot.

23 Claims, 6 Drawing Sheets

STORAGE RACK

REFERENCE TO RELATED APPLICATIONS

This application is a continuation-in-part of United States Patent Application Ser. No. 65,842, filed on June 4, 1987 having a common inventor and entitled STORAGE RACK.

BACKGROUND OF THE INVENTION

This invention relates generally to storage racks, and more specifically storage racks suitable for storing elongated gear, such as rifles, shotguns, fishing rods, and the like.

Persons enJoying sporting activities such as hunting and fishing have a need for a convenient place to store their gear. It is desirable that such storage space be sturdy and reliable, and yet capable of being relocated when the need arises. It is also desirable to be able to store all of one's equipment in a single place.

U.S. Pat. Nos. 3,167,182 to Calvin, 2,797,033 to Rasbach and 2,535,564 to Campbell each disclose gun racks for horizontally storing guns behind the seat of an automobile, having hooks over the top of the seat. U.S. Pat. No. 3,291.317 to Bowen shows a horizontal gun rack with locking means and a storage compartment built in. U.S. Pat. No. 2,577,713 to Nogle shows a portable gun rack having pockets to receive a rifle for horizontal storage. The Nogle gun rack is designed to be hung from a nail or hook. U.S. Pat. Nos. 1,837,939 to Zimmerman and 3,558,090 to Bird disclose approaches to locking a gun barrel in place for storage. U S. Pat. No. 3,907,118 to Pelavin shows a hangar adapted to be hooked over the top of doors. U.S. Pat. No. D272,787 to Rumbaugh discloses a bracket for mounting on a wall for supporting the butt ends of vertically oriented fishing rods, commercially marketed with foam lined recesses. The foregoing devices, while having advantages, do not provide the advantages of the present invention.

The present invention, in one embodiment, is suspended from flexible straps and hooks over the toP of a standard doorway. This is advantageous in that the storage rack is portable and sturdy, and may, for example, be taken to a hunting or fishing lodge on a temporary basis. The present invention also provides, in one embodiment, a fishing tackle box suspended from it, thus providing a single storage place for one's fishing equipment. In addition to the fishing tackle box, a storage compartment is provided, suitable for storing ammunition, fishing reels or other items. The present invention also provides an improved means for holding gun barrels and/or fishing rods, utilizing a velcro strip wrapped therearound to hold the gear in place. Furthermore, an additional confinement strap may be provided. The present device also provides holders projecting laterally outward from the storage rack for holding long fishing rods which are too long to be otherwise stored. The present invention also provides, in one embodiment, a holder for receiving a telescoping fishing rod protection case. In addition to being hung from a door, the present invention also may be hung from a wall or other suitable means. The present invention, in one embodiment, also provides storage for both guns and fishing rods.

SUMMARY OF THE INVENTION

According to one embodiment, the present invention provides a storage rack for holding generally elongated gear such as fishing rods, rifles, and shotguns having an upper and a lower end comprising a lower support member to be mounted along a vertical wall member and having a top surface and means for suspending the lower support member from the vertical wall member; a plurality of means for receiving the lower end of the elongated gear to be stored, at least one of the means for receiving comprising an elongated first recess suitably shaped to receive the butt of a gun, and further comprising a second recess which is smaller than the elongated first recess and which is nested within and below the elongated first recess, the second recess being suitably shaped to receive the butt of a fishing rod therein; and an upper support member to be mounted along the vertical wall member in association with and vertically above the lower support member, the upper support member including means for suspending the upper support member from the vertical wall member and means for holding the upper end of the gear to be stored.

According to another embodiment, the present invention provides a storage rack for holding generally elongated gear such as fishing rods, rifles, and shotguns having an upper and a lower end comprising: a pair of generally vertical suspension members; a lower generally horizontal support member at least partially suspended by the suspension members and having a plurality of recesses along a top surface of the horizontal support member for receiving the lower end of the gear to be stored; upper means for holding the upper end of the gear, the means for holding generally positioned above the lower horizontal support member; and a pair of hooks coupled to a respective one of the pair of generally vertical suspension members, the pair of hooks being adapted to be hooked over the top of a door.

According to another embodiment, the present invention provides a storage rack for holding generally elongated gear such as fishing rods, rifles, and shotguns having an upper and a lower end comprising: a lower support member to be mounted along a vertical wall member and having a top surface with a plurality of means for receiving the lower end of the elongated gear to be stored; and an upper support member to be mounted along the vertical wall member in association with and vertically above the lower support member, wherein the upper support member includes a main body and a slide member laterally slidable with respect:to the main body, the main body having at least one slot therein for receiving the upper end of the gear to be stored, the slide member including at least one arm extending laterally across the slot and laterally movable with respect thereto between an open position and a closed position for opening and closing the slot, wherein the upper support member includes means for locking the slide member having a latch, the latch being movable from an unlocked position to a locked position to block lateral movement of the slide member with respect to the main body when the slide member is in the closed position, wherein the slide member is locked in the closed position.

A general obJect of the present invention is to provide an improved st:rage rack.

These and other obJects of the present invention are disclosed in the following description of the preferred embodiment.

DETAILED DESCRIPTION OF THE DRAWINGS

DESCRIPTION OF THE PREFERRED EMBODIMENT

Figure 1:
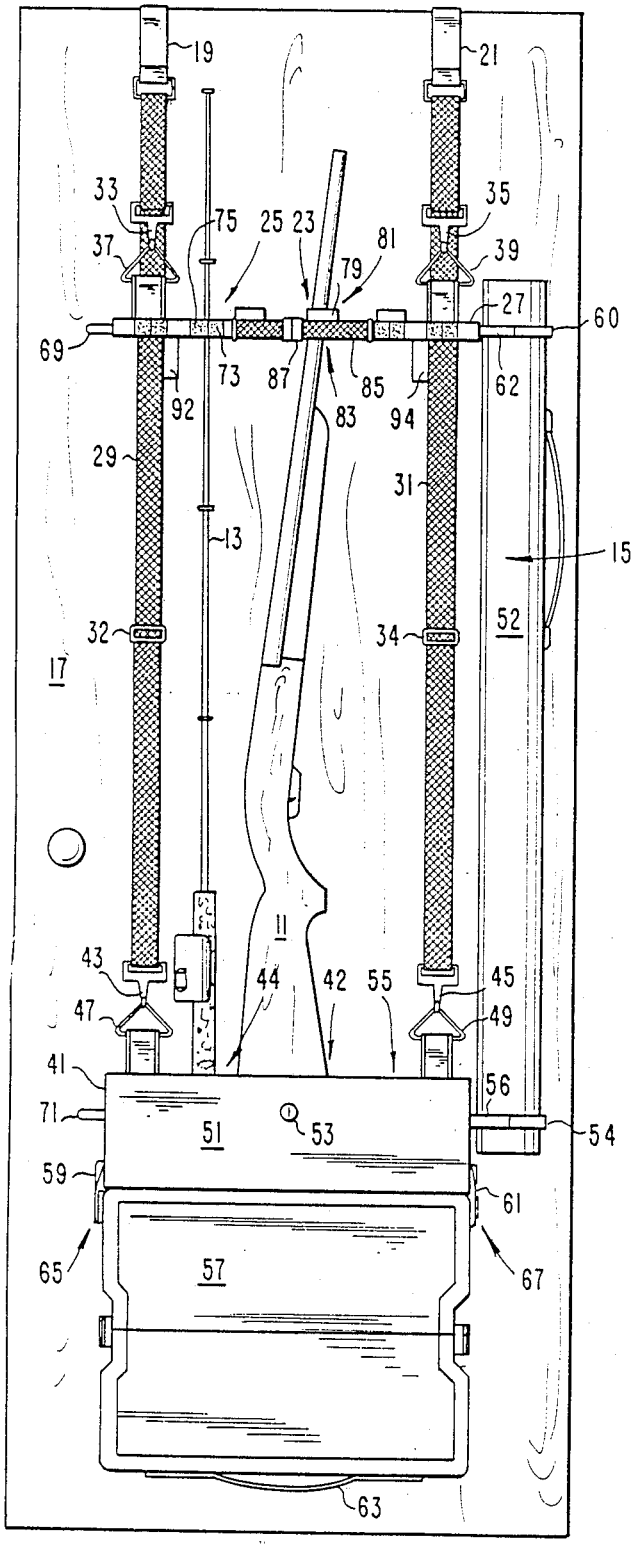
FIG. 1 shows a front view of the storage rack of the present invention hung on a standard door, storing a gun, a fishing rod, and a fishing rod case.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
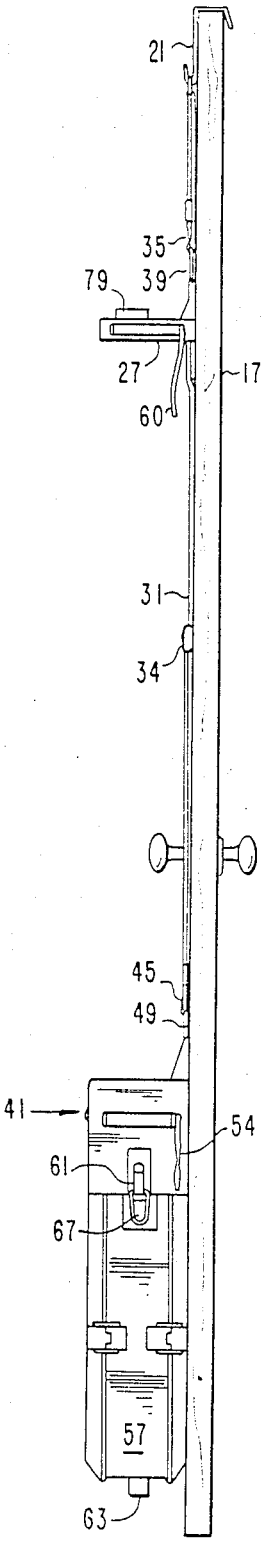
FIG. 2 shows a side view :f the storage rack of FIG. 1 with the gun, fishing r:d, and fishing rod case removed.

Referring now to FIGS. 1 and 2, gun 11 and fishing rod 13 are stored in storage rack 15 hung from the top of door 17 by hooks 19 and 21. The gun and fishing rod each have upper ends 23 and 25, respectively, which are held by upper support member 27, which in turn is suspended from and below hooks 19 and 21. Upper support member 27 is fastened to flexible web straps 29 and 31 which each form generally vertical suspension members hanging from the hooks. Upper support member 27 is connected to straps 29 and 31 by clips 33 and 35 and triangular loops 37 and 39.

Straps 29 and 31 also support lower support member 41 using clips 43 and 45 and triangular loops 47 and 49. Buckles 32 and 34 allow the respective straps 29 and 31 to be adJusted in length. The hooks and straps support, in tension, most of the weight of storage rack 15 as well as the gear being stored therein and thereon. The various clips 33, 35, 43 and 45 are readily detachable from their respective triangular loops 37, 39, 47 and 49 for dismantling the storage rack.

Lower support member 41 is generally horizontal and has door 51 on the front thereof with lock-latch 53 for securing the door closed. Behind door 51 is a storage compartment 58 (See FIG. 7) which is approximately 6"×6" ×20" and is suitable for storing ammunition, fishing reels and other items. Lower member 41 also has a top surface 55 which is generally horizontal and may be flat, but in the best mode, has recesses therein for receiving gun butts and/or fishing rods.

Fishing tackle box 57 is removably suspended below lower member 41 by buckles 59 and 61. Fishing tackle box 57 is, in the best mode, a "Phantom" fishing tackle box (Model No. 1468) offered by Plano Molding Company of Plano, Ill. The fishing tackle box, as shown, is suspended such that handle 63 is directed downwardly. The tackle box, as shown, has been constructed with hooks 65 and 67 added thereto to receive the loop of the respective buckles.

In an alternative embodiment (not shown), not the best mode, small fishing tackle boxes may be used, such as ones offered by Plano Molding Company which have narrower widths. If such tackle boxes are used, a detachable hinge, having a male and female engaging dowel and partial cylinder may be used to couple the tackle box along the lower back edge of lower support member 41. A buckle or latch would be positioned below lock latch 53 to hold the tackle box in place.

Gun 11 has lower end 42, and fishing rod 13 has lower end 44, each lower end being supported by lower member 41, which is adapted with recesses to receive such gear.

Upper support member 27 has rod holders, such as rod holder 69, which project laterally outward from upper member 27. There is a corresponding rod holder 71 which Projects laterally outward from lower support member 41 and is generally below rod holder 69. Rod holder 69 and 71 collectively are adapted to receive a fishing rod therein, each having notches (See FIGS. 5A, 6A) which are pliable so that a rod may be snapped therein. Rod holders 69 and 71 provide a place to store long fishing rods which, if stored like fishing rod 13 in FIG. 1, would interfere with the movement of door 17 and possibly be damaged. UPPer support member 27 and lower support member 41 are both generally rigid, typically being made of wood, metal, or molded plastic.

Telescoping protective fishing rod case 52 is held to lower support member 41 by yoke 56 velcro strap 54 and held to upper support member 27 by yoke 62 and velcro strap 60. These velcro straps are wrapped around telescoping rod case 52 to keep it snugly secured to the storage rack, ready to be removed therefrom for usage. Telescoping protective rod case 52 is a rod holder made by Plano Molding Company of Plano, Ill. (Model No. 3572) which consists of two annularly arranged cylinders which are adapted to be telescoped in a longitudinal manner, providing an elongated tube suitable for protective holding of fishing rods.

Figure 5A:
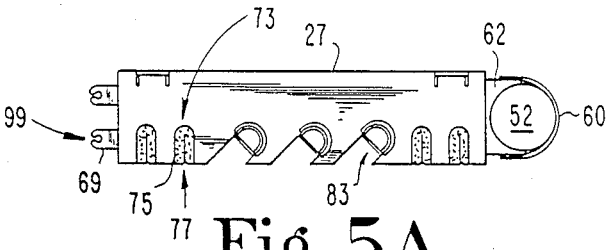
FIG. 5A is a top view of the upper support member of the storage rack of FIG. 1, having three gun barrel slots and four fishing rod slots.

Upper support member 27 also includes rod holders, such as rod holder 73, which comprises 8 U shaped slot cut in member 27 lined with a corresponding U shaped resilient foam liner 75. Resilient foam liner 75 has a slit 77 (See FIG. 5A) therein to snugly receive the upper end of fishing rod 13. Three other rod holders which are essentially the same as rod holder 73 are also shown in FIGS. 1 and 5A.

The upper end of gun 11 is held in upper support member 27 by velcro strap 79, which is fastened to hemi-cylindrical flange 81 projecting upwardly from member 27. Velcro strap 79 wraps around the outer circumference of flange 81 and around the gun barrel which is nested in gun slot 83 and flange 81 (See FIG. 8). Additionally, the gun barrel is confined by strap 85 which is located across the front face of upper support member 27, crossing the various gun slots, such as gun slot 83. Strap 85 has release buckle 87 which may be separated to slacken strap 85 for removal of a gun.

Figure 8:
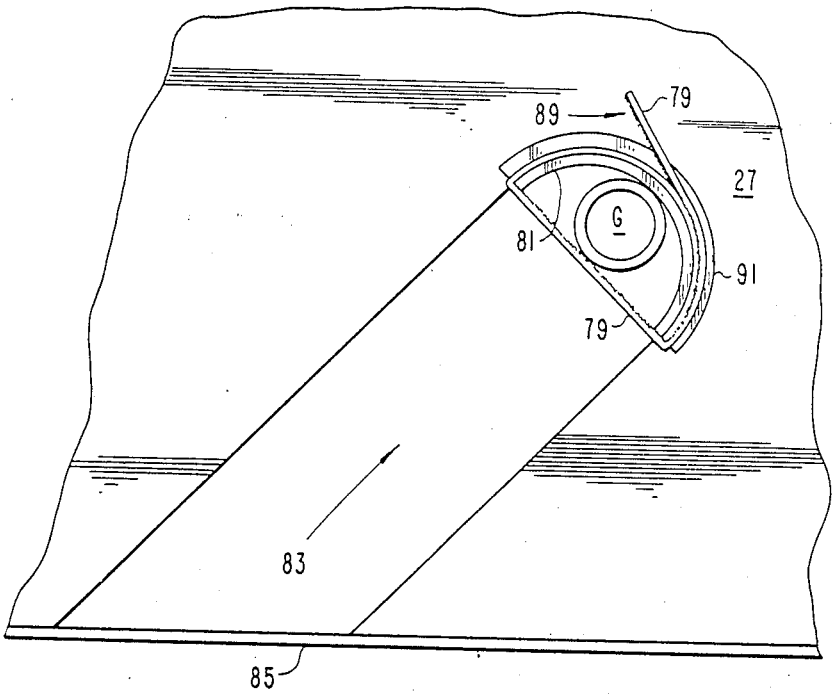
FIG. 8 is a detailed top view of a gun barrel slot of the storage rack of FIG. 1.

Referring now to FIG. 8, a detail of gun slot 83 and the corresponding structure is shown. As shown, strap 85 provides outer confinement while velcro strap 79 wraps around hemi-cylindrical flange 81 and holds the gun barrel designated as G. Note that velcro strap 79 has the fuzzy side 89 facing inwardly and the corresponding prickly side facing outwardly from flange 81. Also, molding 91 provides additional support for flange 81 around its outer circumference near the top surface of member 27.

Figure 3:
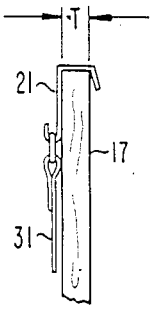
FIG. 3 shows an isolation side view of the hook of the storage rack of FIG. 1 hooked over a doorway having a thickness T.

Referring now to FIG. 3, an isolated side view of hook 21 is shown hooked over door 17. Thickness "T" of door 17 is that of a standard door about 1 ¾" of which hook 21 has a corresponding hook reach :f about 1 ¾". Although thickness "T" will vary with various door designs, the corresponding reach of hook 21 will not exceed 2 ½". Note, hook 21 is typically made of metal or a similar material of suitable strength.

Figure 4:
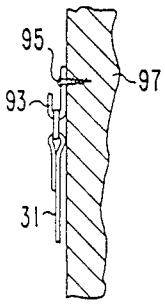
FIG. 4 shows an alternative to the hook shown in FIG. 3, FIG. 4 being a side view of a wall-mounted fitting from which the storage rack of the present invention may be suspended.

Referring now to FIG. 4, an alternative approach is shown in which hook 21 is replaced by wall fitting 93 which, like hook 21, has a small upward turned hook, but unlike hook 21 does not have the downward turned hook adapted to be hooked over a door frame. Instead, screw 95 is fastened into wall 97 to provide support for the storage rack.

Figure 5B:
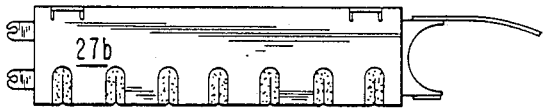
FIG. 5B is a top view of an alternative embodiment to the member of FIG. 5A, having seven fishing rod slots.
Figure 5C:
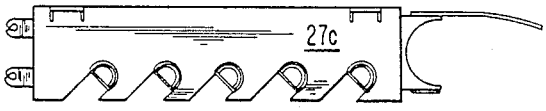
FIG. 5C is a top view of an alternative embodiment to the member of FIG. 5A, having five gun barrel slots.

Referring now to FIGS. 5A, 5B and 5C, various embodiments of the upper support member are shown. FIG. 5A shows the upper support member shown and described in FIG. 1. FIG. 5B shows an alternative upper support member **27*b* which is essentially the same as member 27, except that member 27*b* has seven rod holders, essentially the same as rod holder 73, and no gun slots, whereas member 27 has three gun holders is shown. Furthermore, FIG. 5C shows upper support member 27*c* which differs from member 27 in that support member 27*c* has five gun slots and no fishing rod holders, such as fishing rod holder 73. Note also, rod holder 69 includes notch 99 which is an expandable eyelet suitable to have a fishing rod snapped therein for holding. Also note that there is another such rod holder next to rod holder 69. Note that in FIGS. 5A, 5B, and 5C, straps, such as strap 85**, are not shown for drawing clarity.

Figure 6A:
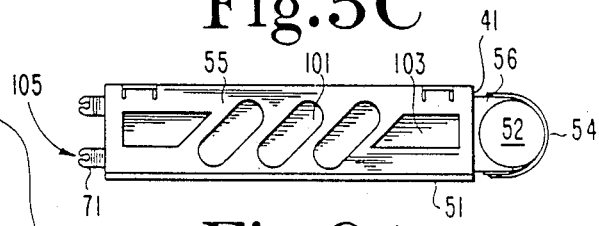
FIG. 6A is a top view of the lower support member of the storage rack of FIG. 1, having three oval gun butt recesses and two enlarged fishing rod recesses.
Figure 6B:
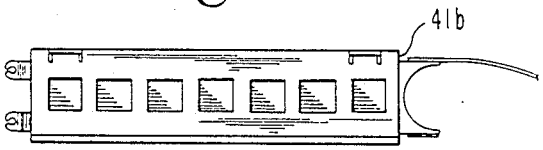
FIG. 6B is a top view of an alternative embodiment to the member of FIG. 6A, having seven fishing rod recesses.
Figure 6C:
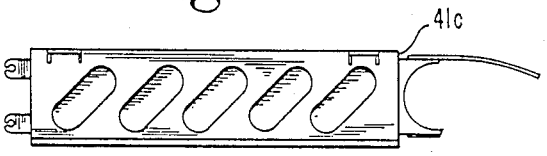
FIG. 6C is a top view of an alternative embodiment to the member of FIG. 6A, having five oval gun butt recesses.

Referring now to FIGS. 6A, 6B and 6C, top views of alternative embodiments of the bottom support member are shown. FIG. 6A shows bottom support member 41, substantially as shown in FIG. 1 and corresponding to upper support member 27 shown in FIG. 5A. Lower support member **41*b* shown in FIG. 6B corresponds to upper support member 27*b* shown in FIG. 5B, adapted to be used together to hold seven fishing rods, not including rods held in rod holders proJecting laterally outward, such as rod holder 69. FIG. 6C shows lower support member 41*c* adapted to receive five gun butts, to be used with upper support member 27*c* shown in FIG. 5C. In FIG. 6A, note that there are three gun butt recesses, such as oval recess 101, which is suitably shaped to generally correspond to the shape of the gun butt, and may alternatively be generally elliptical in shape. Rod recesses, such as rod recess 103, are likewise recessed below top surface 55. These recesses provide lateral support to prevent the rods and/or guns from sliding out of the storage rack. Note that, like rod holder 69 in FIG. 5A, rod holder 71 in FIG. 6A includes a notch 105 suitable for receiving a fishing rod therein. Note that in FIGS. 5B, 5C, 6B and 6C, fishing rod case 52** is not shown, having been removed.

Figure 7:
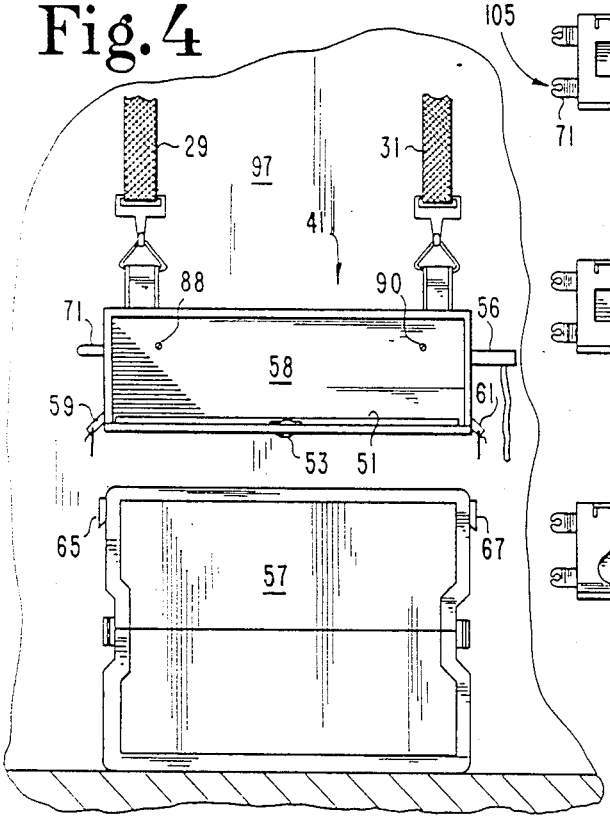
FIG. 7 is a partial front view of one embodiment of the present invention, showing the fishing tackle box separated from the lower support member of the storage rack.

Referring now to FIG. 7, fishing tackle box 57 is shown separated and removed from lower support member 41. Buckles 59 and 61 have been released from hooks 65 and 67, thus allowing tackle box 57 to be removed from the rest of the storage rack. Door 51 is shown in an open position revealing compartment 58. Also note that velcro strap 54 has been separated from yoke 56, with the telescoping protective fishing rod case 52 (as seen in FIG. 1) removed.

Note that screws 88 and 90 may be screwed into wall 97 (or a door) through the back wall of lower support member 41 to provide additional support and minimize rattling and banging of the storage rack. Similar such screws (not shown) may hold upper support member 27 to the door by placing such screws through holes in flanges 92 and 94 (See FIG. 1).

Figure 9A:
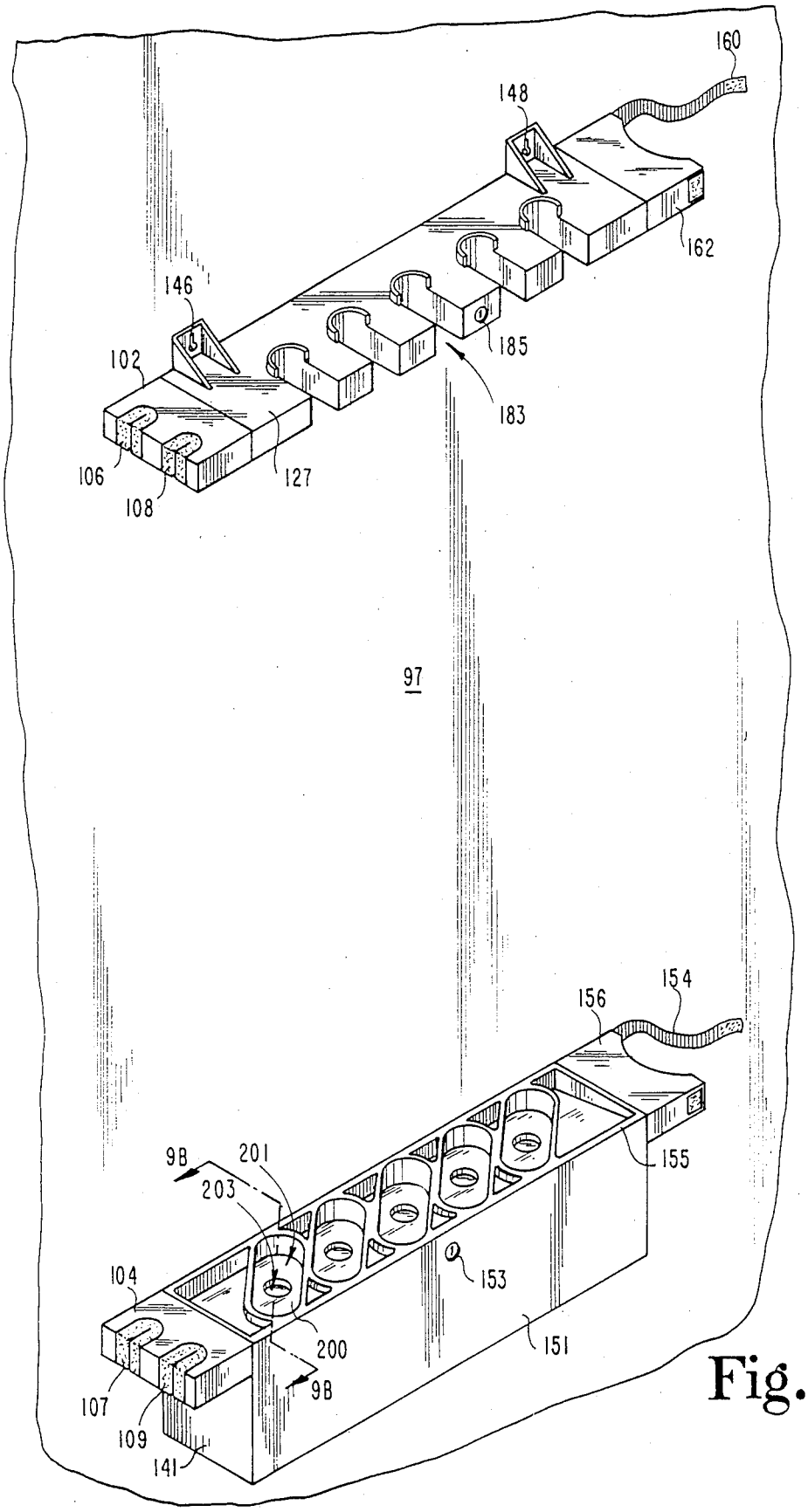
FIG. 9A is a front perspective view of an alternative embodiment of the storage rack of the present invention hung on a wall.
Figure 9B:
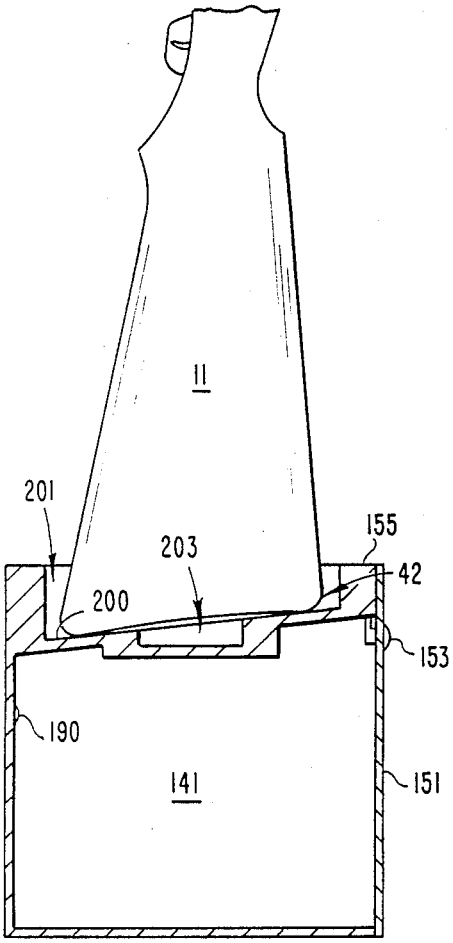
FIG. 9B is a side partial cutaway view of the storage rack of FIG. 9A taken from the perspective of line 9B—9B in FIG. 9A with a gun butt received therein.
Figure 9C:
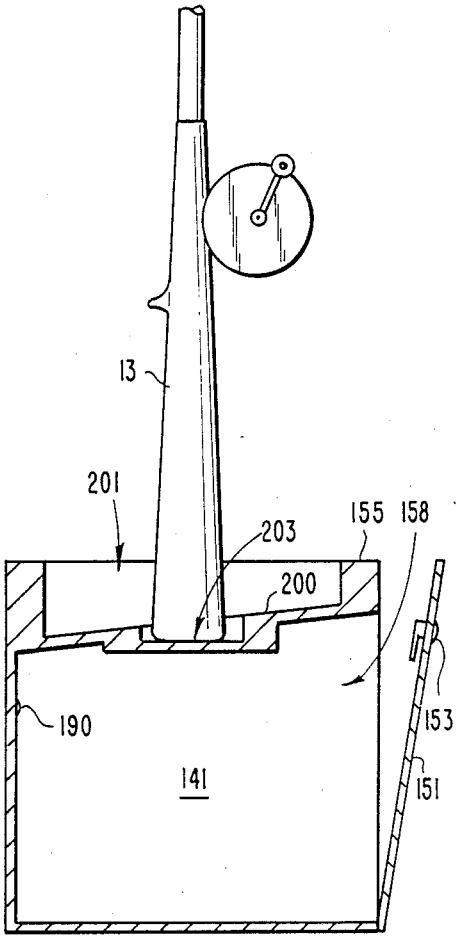
FIG. 9C is a side partial cross section view of the storage rack of FIG. 9A with a fishing rod handle received therein.

Referring now to FIGS. 9A–9D and FIGS. 10A 10D, an alternative embodiment of the present invention is shown. Upper support member 127 and lower support member 141 are shown attached to wall 97. Doors or other such wall members may provide support as well. Lower support member 141 has top surface 155 with a plurality of recesses therein for receiving the lower end of the gear to be stored. As illustrated in FIG. 9A, there are five elongated recesses, such as elongated recess 201, which are suitably shaped to receive the butt of a gun. As illustrated in FIG. 9B, the butt of gun 11 is received in recess 201 below top surface 155 and bearing on gun butt surface 200. Surface 200 is preferably sloped or angled longitudinally along recess 201 to accomodate the taper of the gun butt with respect to vertical. Preferably, recess 201 is oval in shape to conform with the generally oval or generally elliptical profiled shape of the lower end 42 or the butt of the gun to be stored. However, other elongated shapes such as rectangles, ellipses or the like may be used.

A plurality of second recesses, such as recess 203 are provided. Recess 203 is smaller than recess 201 and is nested within and below recess 201. Recess 203 is suitably shaped to receive the lower end 44 or handle of a fishing rod 13 (See FIG. 9C) when no gun butt is present. Thus, the presence of recess 201 and recess 203 provide for a greater latitude in the storage of guns and/or fishing rods. Preferably, recess 203 is round in shape, but may be square, hexgonal or any other variety of shapes so long as it is suitably shaped to receive the fishing rod and prevent undue movement of the fishing rod handle received therein.

Lower support member 141 may include a storage compartment 158 therein for storing a variety of accessories and other gear. For example, compartment 158 may be used to store a fishing tackle box suspended below lower support member 141 and located in storage compartment 158. Alternatively, a fishing tackle box (not shown) may be stored similar to that shown in FIG. 1. Door 151 may be provided to be open to access storage compartment 158. Lock latch 153 may be used to lock door 151 closed. Note that in FIGS. 9B and 9C, lock latch 153 is shown for completeness, notwithstanding the location of line 9B—9B in FIG. 9A. Door 151 is shown partially open in FIG. 9C.

Figure 9D:
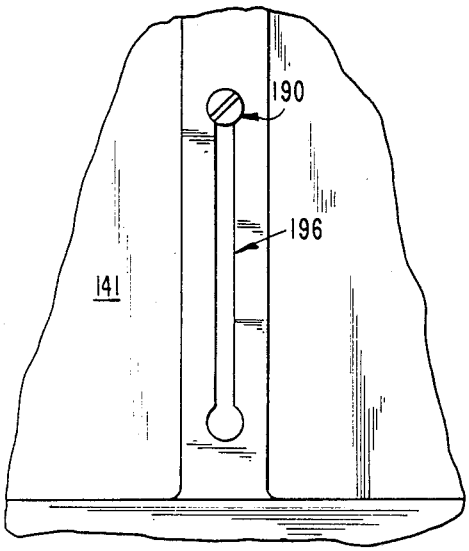
FIG. 9D is a front elevational detail of the inside of the lower support member of the storage rack of FIG. 9A.

As illustrated in FIG. 9D, lower support member 141 is preferably screwed to and suspended from the wall by at least two screws, such as screw 190. Screw 190 is disposed in slot 196 having a eyelet as shown. Screw 190 may include any one of a variety of acceptable screw mechanisms for anchoring into a corresponding wall such as an expansion screw for hollow wall members such as hollow doors, an expanding lead sinker, a toggle bolt, or other suitable means. With amply secure screws, such as screw 190 through slot 196, lower support member 141 may be secured to wall 97 without the need for vertical suspension members as disclosed in the first embodiment shown in FIG. 1. However, the present invention may be used by combining the elements as claimed. For example, vertical suspension members and/or hooks, such as hooks 19 and 21, may be used in conjunction with a lower support member having recesses 201 and 203.

Upper support member 127 is provided to hold the upper end of the elongated gear to be stored. Upper support member 127 is attached to and suspended from wall 97 by screw mount 146 and screw mount 148, and is positioned above and associated with lower support member 141. A plurality of slots, such as slot 183, are disposed along the front edge of upper support member 127. The slots, such as slot 183, are provided to receive the upper end of the elongated gear to be stored, such as a fishing rod or a gun barrel "G" (See FIG. 10A and FIG. 10D). As illustrated, five such slots are shown corresponding to and associated with the five pairs of recesses, such as recesses 201 and 203. Of course, more or less slots and recesses may be used depending on the amount of gear to be stored. For example, two, three, four, six, seven, or more sets of slots and recesses may be used.

A slide member 114 is provided to hold the upper end of the gear to be stored within the slots such as slot 183. Slide member 114 is laterally slidable with respect to main body 112, the two of which collectively comprise upper support member 127 in the illustrated embodiment. Preferably, main body 112 and slide member 114 are made from molded plastic, although a variety of other materials may be used. A plurality of screws, such as screw 124 through slot 122, connect slide member 114 to main body 112. Slot 122 is elongated in a lateral direction and screw 124 is not tightened completely, thereby allowing slide member 114 to be laterally moved with respect to main body 112 along slot 122. Other similar screws and slots are provided as illustrated corresponding to various slots and upper support member 127.

Figure 10A:
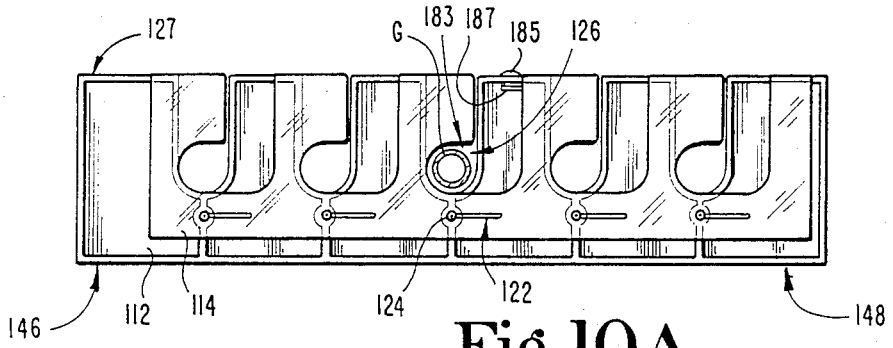
FIG. 10A is a bottom view of the upper support member of the device of FIG. 9A in a closed, locked position with a gun barrel "G" therein.
Figure 10B:
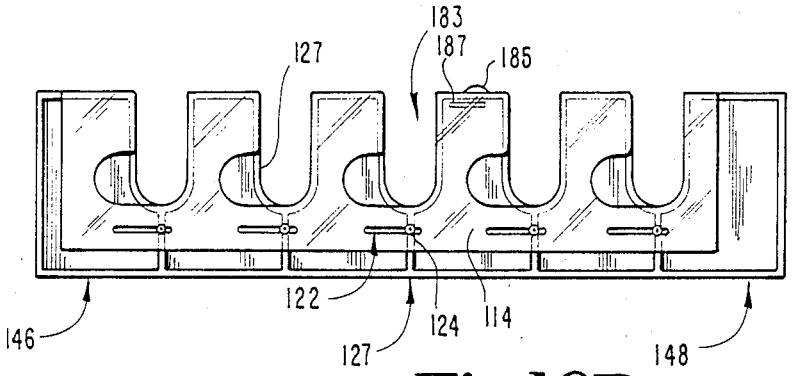
FIG. 10B is a bottom view of the upper support member of the device of FIG. 9A in an open, unlocked position.
Figure 10C:
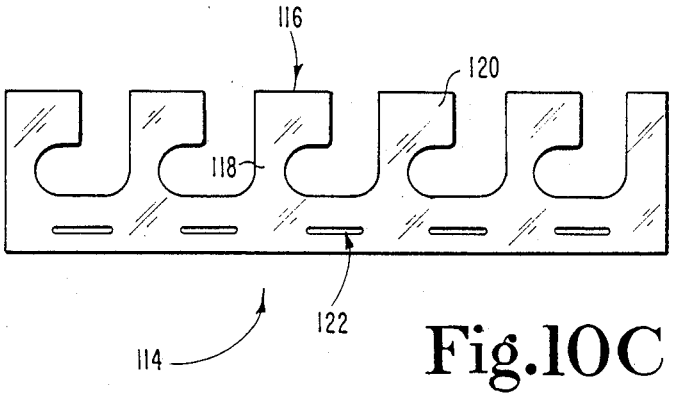
FIG. 10C is a bottom view of a slide member used in the upper support member of the device of FIG. 9A.
Figure 10D:
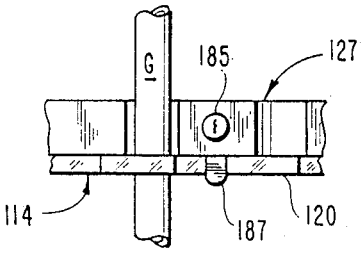
FIG. 10D is a front elevational detail of the upper support member of the device of FIG. 9A in a closed, locked position.

FIG. 10A and FIG. 10B comparatively illustrate how slide member 114 may be laterally moved with respect to main body 112. FIG. 10A illustrates slide member 114 in a closed position (slid to the right in the illustration) forming closure 126 from slot 183. Conversely, FIG. 10B shows slide member 114 in an open position (slid to the left in the illustration) exposing slot 183. In the open position, the elongated gear, such as rifles, shotguns or fishing rods, may be inserted and/or removed from the slots. As illustrated in FIG. 10C, slide member 114 (which may be transparent) has a plurality of L shaped arms proJecting forwardly therefrom corresponding to the slots, such as slot 183. For example, arm 116 projects forward with forward segment 118 and proJects laterally with lateral segment 120 to define hooks projecting forward and laterally across the slots. Slide member 114 is preferrably formed of a unitary piece of plastic, causing the unitary arms to move laterally in unison with respect to the slots. Lateral segment 120 provides the portion of arm 116 across the opening of a slot, such as slot 183, to form a closure, such as closure 126 as illustrated in FIG. 10A. When slide member 114 is in an open position, lateral segment 120 is laterally retracted in the space between the slots for receiving the gear to be stored (See FIG. 1OB).

Lock 185 is provided in upper support member 127. Lock 185 includes latch 187 which, as illustrated in FIG. 10B, may depend downwardly. Lock 185 has a locked position and an unlocked position and is preferably key operated by the same key which unlocks lock 153. In a locked position, latch 187 blocks lateral movement of slide member 114 by abutting lateral segment 120 (See FIG. 10A, FIG. 10D). When lock 185 is unlocked, latch 187 is rotated about 90 degrees up into upper member 127 and out of the way of slide member 114 (See FIG. 10B). Accordingly, a locking mechanism is provided to prevent accidental opening of closure 126. Thus, latch 127 blocks lateral movement of slide member 114, rather than merely impeding lateral movement by a mechanism such as a spring used in earlier devices. Note that this mechanism with slide member 14 and lock 185, as with the other features of this invention, may be combined with features illustrated in the embodiment of FIG. 1.

Another aspect of the present invention is rod holder 102 and rod holder 104 attached to and laterally projecting respectively from upper support member 127 and lower support member 141. Rod holder 102 includes resilient foam liner 106 and resilient foam liner 108 therein, forming U shapes with slits therein. Similarly, resilient foam liner 107 and resilient foam liner 109 are provided in rod holder 104. Accordingly, additional fishing rods may be stored by wedging a fishing rod in foam liner 106 and foam liner 107, and/or by wedging a fishing rod in foam liner 108 and foam liner 109. In this way, additional rods may be stored, especially rods which are particularly long as similar to those discussed in conjunction with rod holder 69 and rod holder 71 above.

Another aspect of the present invention is yoke 162 laterally proJecting from upper support member 127 and yoke 156 laterally projecting from lower support member 141. A strap 154 and a strap 160 are provided on yoke 156 and yoke 162 respectively for holding gear such as telescopic fishing rod case 52 as illustrated in FIG. 1. Note that optionally, additional fishing rod holders, similar to rod holder 102 and rod holder 104, may be substituted for yoke 156 and yoke 162 for additional storage capacity of long fishing rods rather than storage capacity of a fishing rod case. Similarly, two pairs of yokes may be provided, one on either lateral side of the storage rack, for storage of two telescopic fishing rod cases. Rod holders 102 and 104 and yokes 156 and 162 may be separately molded and attached to their respective upper and lower support members by screws or other suitable means.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A storage rack for holding generally elongated gear such as fishing rods, rifles, and shotguns having an upper and a lower end comprising:

a lower support member to be mounted along a vertical wall member and having a top surface and means for suspending said lower support member from the vertical wall member., a plurality of means for receiving the lower end of the elongated gear to be stored, at least one of said means for receiving comprising an elongated first recess suitably shaped to receive the butt of a gun, and further comprising a second recess which is smaller than said elongated first recess and which is nested within and below said elongated first recess, said second recess being suitably shaped to receive the butt of a fishing rod therein; and an upper support member to be mounted along the vertical wall member in association with and vertically above said lower support member, said upper support member including means for suspending said upper support member from the vertical wall member and means for holding the upper end of the gear to be stored.

2. The rack of claim 1 wherein said upper support member includes a main body and a slide member laterally slidable with respect to said main body, said main body having at least one slot therein for receiving the upper end of the gear to be stored, said slide member including at least one arm extending laterally across said slot and laterally movable with respect thereto between an open position and a closed position for opening and closing said slot for the upper end of the gear to be stored.

3. The rack of claim 2 wherein said main body of said upper support member has a plurality of slots for receiving the upper end of the gear to be stored, and wherein said slide member includes a plurality of arms corresponding to said plurality of slots and extending laterally across said slots and laterally movable in unison with respect to said slots for opening and closing said slots for the upper end of the gear to be stored.

4. The rack of claim 3 wherein said lower support member includes a storage compartment therein and a compartment door openable to access said storage compartment.

5. The rack of claim 4 wherein said elongated first recess is oval shaped and wherein said second recess is round shaped.

6. The rack of claim 5 and including first and second generally vertical suspension members attached to said upper support member and to said lower support member.

7. The rack of claim 6 and further comprising a lower means for holding rods projecting laterally outward from said lower support member, and an upper means for holding rods projecting laterally outward from said upper support member, said upper means for holding rods being positioned generally above said lower means for holding rods.

8. The rack of claim 7 and further comprising means for holding a fishing rod case being supported by said upper support member and by said lower support member.

9. The rack of claim 8 and further comprising a pair of hooks coupled to a respective one of said first and second generally vertical suspension members, said pair of hooks being adaPted to be hooked over the top of a door.

10. The rack of claim 9 and further comprising a fishing tackle box suspended below said lower support member and located in said storage compartment.

11. The rack of claim 1 wherein said lower support member includes a storage compartment therein and a compartment door openable to access said storage compartment.

12. The rack of claim 1 and including first and second generally vertical suspension members attached to said upper support member and to said lower support member.

13. The rack of claim 1 and further comprising a fishing tackle box suspended below said lower support member.

14. The rack of claim 1 wherein said elongated first recess is oval shaped and wherein said second recess is round shaped.

15. The rack of claim 1 and further comprising a lower means for holding rods projecting laterally outward from said lower support member, and an upper means for holding rods proJecting laterally outward from said upper support member, said upper means for holding rods being positioned generally above said lower means for holding rods.

16. The rack of claim 1 and further comprising means for holding a fishing rod case being supported by said upper support member and by said lower support member.

17. The rack of claim 2 wherein said upper support member includes means for locking said slide member having a latch, said latch being movable from an unlocked position to a locked position to block lateral movement of said slide member with respect to said main body when said slide member is in said closed position, whereby said slide member is locked in said closed position.

18. The rack of claim 12 and further comprising a pair of hooks coupled to a respective one of said first and second generally vertical suspension members, said pair of hooks being adapted to be hooked over the top of a door.

19. A storage rack for holding generally elongated gear such as fishing rods, rifles, and shotguns having an upper and a lower end comprising:

a pair of generally vertical suspension members;

a lower generally horizontal support member at least partially suspended by said suspension members and having a plurality of recesses along a top surface of said horizontal support member for receiving the lower end of the gear to be stored;

upper means for holding the upper end of the gear, said means for holding generally positioned above said lower horizontal support member; and a pair of hooks coupled to a respective one of said pair of generally vertical suspension members, said pair of hooks being adapted to be hooked over the top of a door.

20. A storage rack for holding generally elongated gear such as fishing rods, rifles, and shotguns having an upper and a lower end comprising:

a lower support member to be mounted along a vertical wall member and having a top surface with a plurality of means for receiving the lower end of the elongated gear to be stored, wherein said lower support member includes a storage compartment therein and a compartment door openable to access said storage compartment; and an upper support member to be mounted along the vertical wall member in association with and vertically above said lower support member, wherein said upper support member includes a main body and a slide member laterally slidable with respect to said main body, said main body having at least one slot therein for receiving the upper end of the gear to be stored, said slide member including at least one arm extending laterally across said slot and laterally movable with respect thereto between an open position and a closed position for opening and closing said slot, wherein said upper support member includes means for locking said slide member having a latch, said latch being movable from an unlocked position to a locked position to block lateral movement of said slide member with respect to said main body when said slide member is in said closed position, wherein said slide member is locked in said closed position.

21. A storage rack for holding generally elongated gear such as fishing rods, rifles, and shotguns having an upper and a lower end comprising:

a lower support member to be mounted along a vertical wall member and having a top surface with a plurality of means for receiving the lower end of the elongated gear to be stored; and an upper support member to be mounted along the vertical wall member in association with and vertically above said lower support member, wherein said upper support member includes a main body and a slide member laterally slidable with respect to said main body, said main body having at least one slot therein for receiving the upper end of the gear to be stored, said slide member including at least one arm extending laterally across said slot and laterally movable with respect thereto between an open position and a closed position for opening and closing said slot, wherein said upper support member includes means for locking said slide member having a latch, said latch being movable from an unlocked position to a locked position to block lateral movement of said slide member with respect to said main body when said slide member is in said closed position, wherein said slide member is locked in said closed position, and including first and second generally vertical suspension members attached to said upper support member and to said lower support member.

22. A storage rack for holding generally elongated gear such as fishing rods, rifles, and shotguns having an upper and a lower end comprising:

a lower support member to be mounted along a vertical wall member and having a top surface with a plurality of means for receiving the lower end of the elongated gear to be stored;

an upper support member to be mounted along the vertical wall member in association with and vertically above said lower support member, wherein said upper support member includes a main body and a slide member laterally slidable with respect to said main body, said main body having at lest one slot therein for receiving the upper end of the gear to be stored, said slide member including at least one arm extending laterally across said slot and laterally movable with respect thereto between an open position and a closed position for opening and closing said slot, wherein said upper support member includes means for locking said slide member having a latch, said latch being movable from an unlocked position to a locked position to block lateral movement of said slide member with respect to said main body when said slide member is in said closed position, wherein said slide member is locked in said closed position; and lower means for holding rods projecting laterally outward from said lower support member, and an upper means for holding rods projecting laterally outward from said upper support member, said upper means for holding rods being positioned generally above said lower means for holding rods.

23. A storage rack for holding generally elongated gear such as fishing rods, rifles, and shotguns having an upper and a lower end comprising:

a lower support member to be mounted along a vertical wall member and having a top surface with a plurality of means for receiving the lower end of the elongated gear to be stored;

an upper support member to be mounted along the vertical wall member in association with and vertically above said lower support member, wherein said upper support member includes a main body and a slide member laterally slidable with respect to aid main body, said main body having at least one slot therein for receiving the upper end of the gear to be stored, said slide member including at least one arm extending laterally across said slot and laterally movable with respect thereto between an open position and a closed position for opening and closing said slot, wherein said upper support member includes means for locking aid slide member having a latch, aid latch being movable from an unlocked position to a locked position to block lateral movement of said slide member with respect to said main body when said slide member is in said closed position, wherein said slide member is locked in said closed position; and means for holding a fishing rod case being supported by said upper support member and by said lower support member.

* * * * *

UNITED STATES PATENT AND TRADEMARK OFFICE

CERTIFICATE OF CORRECTION

PATENT NO. : 4,986,427

DATED : January 22, 1991

INVENTOR(S) : Donel G. Law et al.

It is certified that error appears in the above-identified patent and that said Letters Patent is hereby corrected as shown below:

At column 1, line 7, "4, 1987" should read --24, 1987--.

At column 1, line 15, "enJoying" should read --enjoying--.

At column 1, line 41, "toP" should read --top--.

At column 2, line 64, "obJect" should read --object--.

At column 2, line 65, "st:rage" should read --storage--.

At column 3, line 7, ":f" should read --of--.

At column 3, line 8, "r:d" should read --rod--.

At column 3, line 9, "." should read --;--.

At column 4, line 23, "adJusted" should read --adjusted--.

At column 4, line 63, "Projects" should read --projects--.

At column 5, line 3, "UPPer" should read --Upper--.

At column 5, line 19, "comprises 8" should read --comprises a--.

At column 5, line 50, ":f" should read --of--.

At column 6, line 1, "is" should read --as--.

At column 6, line 20, "proJecting" should read --projecting--.

UNITED STATES PATENT AND TRADEMARK OFFICE

CERTIFICATE OF CORRECTION

PATENT NO. : 4,986,427

DATED : January 22, 1991

INVENTOR(S) : Donel G. Law et al.

It is certified that error appears in the above-identified patent and that said Letters Patent is hereby corrected as shown below:

At column 6, line 52, "10A 10D" should read --10A-10D--.

At column 8, line 23, "proJecting" should read --projecting--.

At column 8, line 26, "proJects" should read --projects--.

At column 9, line 4, "proJecting" should read --projecting--.

At column 9, line 36, "." should read --;--.

At column 10, line 50, "proJecting" should read --projecting--.

At column 12, line 20, "lest" should read --least--.

Signed and Sealed this

Twenty-third Day of June, 1992

*Attest:*

DOUGLAS B. COMER

*Attesting Officer*

*Acting Commissioner of Patents and Trademarks*